US005119967A

United States Patent [19]

Ercolani

[11] Patent Number: 5,119,967

[45] Date of Patent: Jun. 9, 1992

[54] ONE HANDED CONTROLLABLE PLATE AND CUP HOLDER

[76] Inventor: David A. Ercolani, 40 Holly St., Gloucester, Mass. 01930

[21] Appl. No.: 726,300

[22] Filed: Jul. 5, 1991

[51] Int. Cl.[5] ..... H61D 1/30

[52] U.S. Cl. ..... 220/23.6; 220/238; 220/737; 206/565; 206/564; 206/503

[58] Field of Search ..... 206/558, 564, 557, 503, 206/509, 565; 220/23.8, 23.83, 23.86, 23.4, 23.6, 737

[56] References Cited

U.S. PATENT DOCUMENTS

| | | | |
|---|---|---|---|
| 2,511,537 | 6/1950 | Migdow | 206/1.7 |
| 2,808,191 | 10/1957 | Cramer | 229/30 |
| 2,909,797 | 10/1959 | White | 220/23.8 |
| 3,115,251 | 12/1963 | Farrell | 211/41 |
| 3,376,974 | 4/1968 | Hilliard | 206/22 |
| 4,461,396 | 7/1984 | Harper | 220/23.8 |
| 4,534,469 | 8/1985 | Elsmo | 206/560 |
| 4,562,926 | 1/1986 | Mode | 206/563 |
| 4,732,274 | 3/1988 | Bouton | 220/23.8 |
| 4,785,959 | 11/1988 | Kleiner | 220/23.83 |
| 4,823,958 | 4/1989 | Mahmud | 220/23.8 |
| 4,867,331 | 9/1989 | Tasic | 220/23.8 |

FOREIGN PATENT DOCUMENTS

| | | | |
|---|---|---|---|
| 2078493 | 1/1982 | United Kingdom | 220/23.8 |

*Primary Examiner*—Joseph Man-Fu Moy
*Attorney, Agent, or Firm*—Donald N. Halgren

[57] ABSTRACT

A foot plate and beverage container support assembly having a handle arranged on the bottomside of its base, to permit a user to conveniently carry food, beverages and utensils with one hand while permitting the user's other hand to be free eating or drinking from that held food plate and beverage container support assembly.

17 Claims, 1 Drawing Sheet

ONE HANDED CONTROLLABLE PLATE AND CUP HOLDER

BACKGROUND OF THE INVENTION

1. Field of the Invention

This invention relates to holders for plates and cups and more particularly with such arrangements which are single handedly controllable.

2. Prior Art

Dinner functions, parties and buffet type eating assemblies often require a balancing act on behalf of the invitees. The plate is usually held in one hand, the utensils or a drink in the other hand and the remaining item usually placed somewhere and subsequently lost or tipped over. Solutions to enable guests at dinner functions, to hold a plate and a drink simultaneously while being able to eat, have been very poor indeed. Balancing the two while in fact eating is very difficult. An example of the prior art is shown in U.S. Pat. No. 3,115,251 to Farrell, wherein a plate and cup holder is shown formed from a piece of sheet metal. While the plate and cup holder rather do in fact hold those items, they don't permit the user to readily balance it and eat from the same.

U.S. Pat. No. 3,376,974 to Hilliard shows a combination carrying tray, placemat and utensil holder which is constructed in a book like fashion having a pair of holes which, when folded over, provides a space for a drink or a cup to be held. The utensils unfortunately are held within the book like folder and are inherently difficult to get if one was eating from that placemat or tray. U.S. Pat. No. 4,534,469 to Elsmo shows a tray assembly with a cup holder thereon, including means for holding utensils. Unfortunately, no means are shown to help balance the tray or to enable one to eat from it very readily while in fact holding it in ones hands. U.S. Pat. No. 4,562,926 to Mode shows a foldable paper board tray having a cup holding means and several compartments folded thereon. The limited ability of this tray to function as an eating platform is evident.

U.S. Pat. No. 4,785,959 to Kleiner shows a combination cup and plate holder wherein a clip means is utilized to grab the side of a plate, the clip means having a rounded formed cup holder attached thereto. Balancing of the plate and cup while eating could very easily be a problem here. U.S. Pat. No. 2,808,191 to Cramer and U.S. Pat. No. 3,061,390 to Walsh et al each show a lap type tray for holding a plate and/or a drinking cup. The lap tray characteristics of these devices fail to enable a person to hold it in a single handed manner.

It is an object of the present invention to provide a reusable plate and cup holder assembly which is an improvement over the prior art. It is a further object of the present invention to provide a plate and cup holder assembly which is readily controllable by a single hand of the user.

BRIEF SUMMARY OF THE INVENTION

The present invention comprises a one handed controllable plate and cup holder assembly, preferably made from an injection molded resin, having a plate holding means on one portion thereof and a cup or drink holding means on another portion thereof, with a control means disposed upon the bottom of the assembly, to permit the user to balance the holder assembly with one hand while the user eats the food therefrom with the other hand.

The controllable plate and cup holder assembly is an elongated structure having a first end which is wide enough to have a receptacle means for safely supporting a beverage container therewithin. The plate and cup holder assembly has a second end wide enough to comprise the plate holder configuration. Midway between the beverage container holding portion and the plate holding portion, there is disposed a utensil holding means. A support balancing means is disposed across the bottom portion of the plate holder portion. The balancer portion comprises a handle like frame into which a user may snugly insert one hand preferably in a palm-up orientation.

A downwardly directed lip is disposed around the outer lower perimeter of the plate and cup holder assembly. The upper peripheral edge of the plate and cup holder assembly has a curved periphery. The inner side of the downwardly directed lower lip matches the shaped configuration of the periphery around the outer upper edge of the plate and cup holder assembly, so as to permit a nestable stackability thereof. The beverage container support has articulable frame extending therebeneath. The plate holder portion of the plate and cup holder assembly may itself comprise a plate, or it may comprise a plate holding means. The plate holding means would comprise a plurality of radially or diametrically disposed ribs extending across the bottom of the plate holder portion. A plurality of standoffs may be disposed upwardly around the edge of the plate holder assembly to hold a plate securely therewithin.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
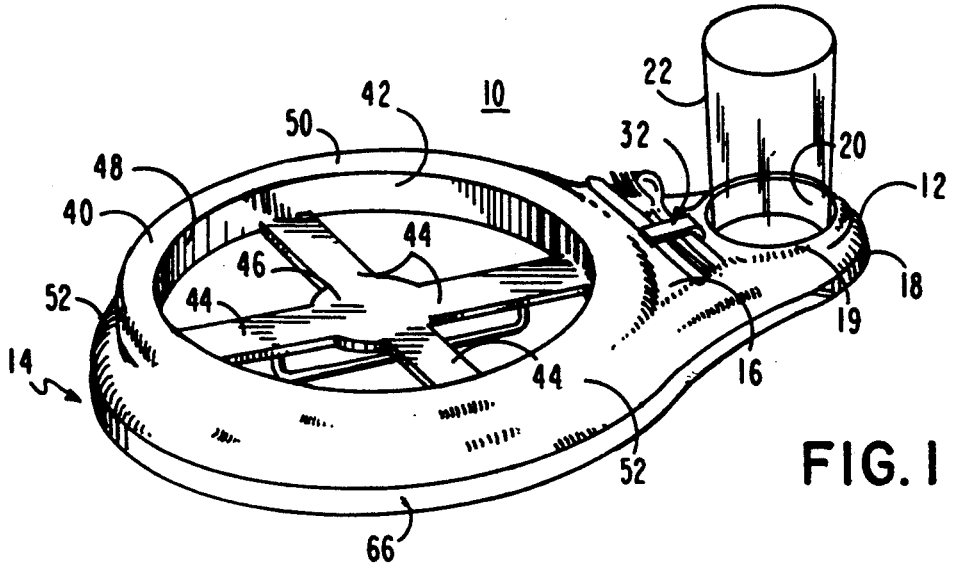
FIG. 1 is a perspective view of a one handed controllable plate and cup holder assembly showing utensils and the beverage container associated therewith.

Referring now to the drawings in detail, and particularly to FIG. 1, there is shown a one hand controllable plate and cup holder assembly 10 having a generally elongated planer base with a first end 12 of semi-circular shape and a second end 14 of three-quarter circular shape. The first end 12 and second end 14 are connected by a web 16 unitary with both ends. For exemplary purposes only, the first end 12 may have a transverse diameter across its semi-circular configuration, of about 12 centimeters, that is, wide enough to have a beverage container support arrangement therein, and the second end 24 may have a transverse diameter across its widest portion, of about 30 centimeters, which is wide enough to hold a typical standard diameter dinner plate.

The plate and cup holder assembly 10 is preferrably formed from an injected molded plastic resin, although it could be manufactured from metal or stiffened paperboards.

The first end 12 has, as aforementioned, a curvilinear semi-circular periphery 18. An annular ridge 19 defines a circular opening 20 in the first end 12. The ridge 19 is arranged so as to be contiguous with the web 16. The opening 20 is about 10 centimeters in diameter, sufficient to receive a typical glass 22, cup or tonic can therein. A support bracket 24, shown most clearly in FIG. 2, has a pair of upwardly directed arms 28 pivotably attached to the bottomside of the assembly 10, on tabs 26. The support bracket 24, is of generally U-shape, having a lowermost transverse portion 30 adapted to engage the bottom of a container, such as the glass 22 shown in phantom lines in FIG. 2.

Figure 2:
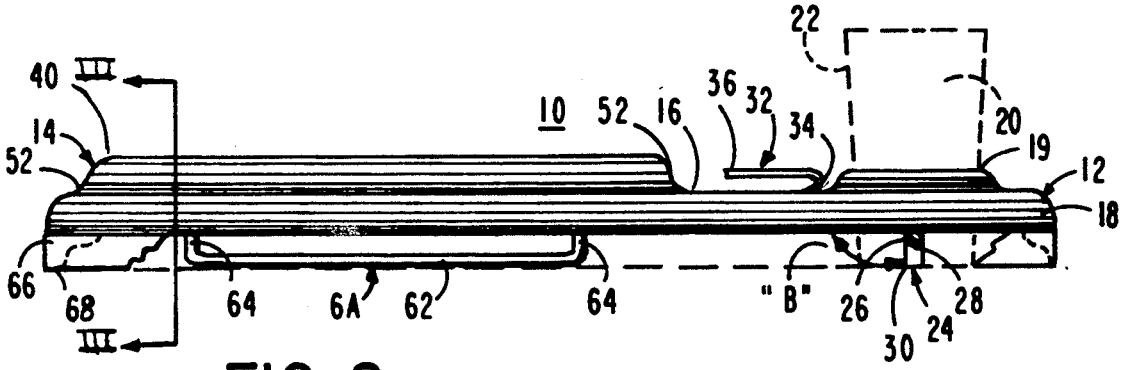
FIG. 2 is a side elevational view of the plate and cup holder assembly shown in figure one.

The support bracket 24 is pivotable 90 degrees to the side as shown by the arrow "B" in FIG. 2, so as to facilitate stacking of one plate and cup holder assembly 10 upon another, without the bracket 24 engaging a ridge 19 of an assembly 10 beneath it, with minimum interference with one another, and while also minimizing the height of a stacked plurality of such assemblies.

A utensil holding means 32, of "L" shaped configuration, is attached by an upright portion 34 to the web 16. The utensil holding means 32 also includes a clip or resiliant finger 36, adapted to secure utensils such as forks and spoons etc, between it and the web 16.

The second end 14 of the plate and cup holder assembly 10 comprises the widest portion of the assembly 10, which includes an annular rim 40 that defines an enlarged cavity 42. The cavity 42 has bottom portion comprising a plurality of radially directed ribs 44 extending from a central junction 46, as shown in FIG. 1. The annular rim 40 includes an inner annular generally vertical wall 48, a rounded upper edge 50 and an outer wall 52 of stepped configuration. The ribs 44 may define open segments therebetween, or they may consist of reinforcement with a web of material disposed therebetween.

A rigid bracket 60 is evenly disposed across the bottom side of the central junction 46 and is joined to the bottomside of two of the opposed ribs 44, as shown in FIG. 2. The bracket 60 comprises a horizontal strap component 62 and a pair of side bars 64 which are attached to the bottomside of the ribs 44 as aforementioned. The side bars 64 are about 3 cm. long, sufficient to put the fingers and palm of a hand between the strap component 62 and the ribs 44 in a snug fitting relationship.

A downwardly directed lip 66 extends around the lower periphery of the plate and cup holder assembly 10, as shown in FIGS. 1 and 2. The lip 66 has a lowermost edge 68 which extends just beneath the lowermost side of the horizontal strap component 62. The lip 66 has an inner wall 70 of stepped configuration which matches the shoulder of the stepped configuration of the outer wall 52 of the annular rim 40 as may be seen between the "almost nested" or stacked assemblies shown in FIG. 3. The downwardly directed lip 66 may extend continuously about the bottom periphery of the plate and cup holder assembly 10, or it may be spaced, with open portions therebetween, so as to be discontinous.

Figure 3:
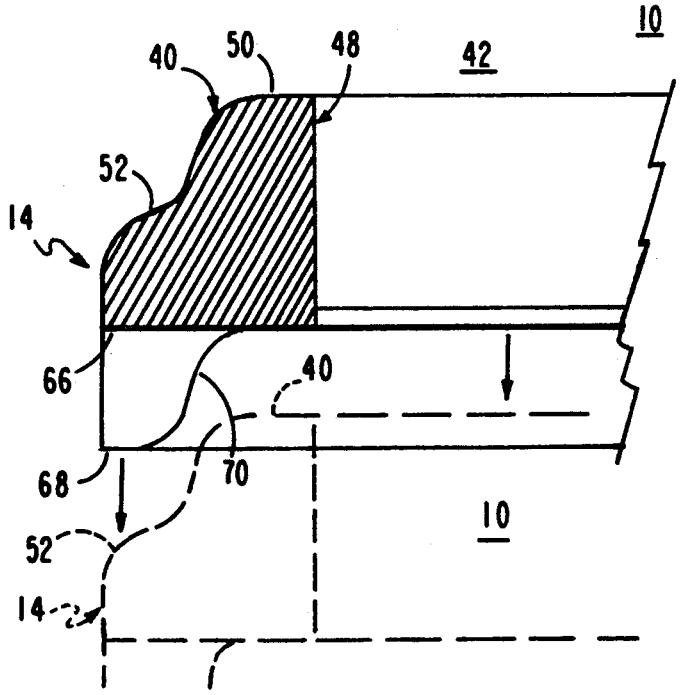
FIG. 3 is a sectional view taken along the lines A—A of FIG. 2 showing the stackability characteristics of the plate and cup holder assembly.

The inner wall 70 rests upon the corresponding portion of the outerwall 52 in a stacked arrangement of plate and cup holder assemblies 10, as shown in FIG. 3. When a plate and cup holder assembly 10 is in fact stacked on top of one another plate and cup holder assembly 10, the bracket 60, extends into the enlarged cavity 42, without the bracket interfering with the ribs 44 or the wall 48 of the cavity 42.

The support bracket 24 is pivoted 90 degrees to the horizontal so that it does not interfere with the annular ridge 19, because the bracket 24 is larger than the opening 20 and therefore will not properly mate therewith.

The bracket 60 permits a person who is carrying the plate and cup holder assembly 10 to put a hand between the bracket 60 and the bottomside of the ribs 44, or bottomside of the webs therebetween, so as to control the pitch and yaw of the plate and cup holder assembly 10 with only one hand, while being able to use his other hand to eat or drink.

The bottom or lower surface of the cavity 42 may be a solid web of material, the cavity 42 itself act as the "dinner plate" for the emplacement of food.

The overall configuration of the preferred embodiment as represented in FIG. 1 is that generally of a "figure 8", that is, two spaced apart annular rims 19 and 40 defining two "openings" 20 and 42 of substantially different diameters (about 10 cms. vs. about 30 cms), with an intermediately dimensioned integral web 16 of material joining the two rims 19 and 40. An advantage of this configuration is that in addition to being stackable one on top of the other as aforementioned, a pair of plate and cup holder assemblies 10 (or a pair of stacks of plate and cup holder assemblies 10) may be stored (or shipped) first end 12 of one plate and cup holder assembly 10 adjacent the second end 14 of another plate and cup holder assembly 10, thereby taking up a generally rectangular "foot-print". This minimizes the volume of space needed for storing or shipping a quantity of these plate and cup holder assemblies 10.

Thus, what has been show is a unique product for supporting a plate and beverage cup and utensils, which is controllable in a secure and manipulable manner, the product being manufacturable in a simple manner, which products are stackable one on top of the other, and which product because of its peripheral shape or "foot-prints", being considerably smaller across one end than the other, allows "opposed" storage in typical rectangular storage facilities such as boxes or cabinets or the like.

That is, the invention comprises an assembly for supporting a plate and a beverage container simultaneously, while being securely manipulable by one hand of a user carrying the assembly, including an elongated base having a first end and a second end, the first end having an annular ridge which defines an opening for supporting a beverage container the secured end being wider than the first end and having an annular ridge which defines a cavity for carrying a dinner plate; and a bracket arranged on the bottom side of the second end to receive the hand of a user carrying the assembly and allow the user firm balanced control over its movement.

The assembly includes a support bracket which is disposed across the bottom of the opening defined by the annular ridge on the first end of the assembly, to engage the bottom of a container disposed within that opening.

The support bracket being pivotably connected to a pair of tabs on the bottom of the assembly at the first end thereof, to permit the support bracket to pivot to one side of the beverage holder opening when one assembly is placed upon another assembly for stacking thereof. The base has a peripheral lip extending downwardly therearound, the downwardly extending peripheral lip having an inner wall with a stepped shoulder configuration. The annular ridges at both the first end and the second end have outer curvilinear walls which have a stepped shoulder configuration which are complimentary to and matable with the inner stepped shoulder configuration of the peripheral lip which extends downwardly around the base, to permit the stable stacking of a plurality of plate and cup holder assemblies theretogether.

The base includes a web portion disposed between the annular ridge of the first end and the annular ridge at the second end thereof, the web portion having a utensil securing means thereon. The utensil securing means comprises a flexible finger attached to the web to engage utensils between it and the web.

The base is generally of planar form having a peripheral configuration of generally a "figure 8", one end being of substantially greater width than the other end, and the cavity in the second end has a lower portion with a plurality of ribs or a solid web extending thereacross, the ribs or solid web having an upper surface and a lower surface, the bracket being attached to the lower surface of the ribs. The "control" bracket mates within the cavity in the second end of the base when one plate and a cup holder assembly is vertically stacked onto another plate and a cup holder assembly.

I claim:

1. An assembly for supporting a plate and a beverage container simultaneously, while being securely manipulable by one hand of a user carrying the assembly, comprising:

an elongated base having a first end and a second end, said first end having an annular ridge which defines an opening for supporting a beverage container, said second end being wider than said first end and having an annular ridge which defines a cavity which may emplacively support a plate means;

a bracket means arranged on the bottom side of said second end to receive the hand of a user carrying said assembly and permit the user firm control over the movement and balance thereof; and a support bracket disposed across the bottom of the opening on the first end of said assembly, to engage the bottom of a container disposed within said opening.

2. An assembly for supporting a plate and a beverage container simultaneously, as recited in claim 1, wherein said support bracket is pivotably connected to a pair of tabs on the bottom of said assembly at said first end thereof, to permit said support bracket to pivot to one side when one assembly is placed upon another assembly for stacking thereof.

3. An assembly for supporting a plate and a beverage container simultaneously, as recited in claim 1, wherein said base has a peripheral lip extending downwardly therearound, said downwardly extending peripheral lip having an inner wall with a stepped shoulder configuration.

4. An assembly for supporting a plate and a beverage container simultaneously, as recited in claim 3 wherein said annular ridges at both said first end and said second end have outer curvilinear walls which have a stepped shoulder configuration which is conformable to and matable with the inner stepped shoulder configuration of said peripheral lip which extends downwardly from said base, to permit the stable stacking of a plurality of said plate and cup holder assemblies theretogether.

5. An assembly for supporting a plate and a beverage container simultaneously, as recited in claim 4, wherein said base includes a web portion disposed between said annular ridge of said first end and said annular ridge at said second end thereof, said web portion having a utensil securing means thereon.

6. An assembly for supporting a plate and a beverage container simultaneously, as recited in claim 5 wherein said utensil securing means comprises a flexible finger attached to said web to engage utensils therebetween.

7. An assembly for supporting a plate and a beverage container simultaneously, as recited in claim 5, wherein said base is of generally planar form having a peripheral configuration of generally a "figure 8".

8. An assembly for supporting a plate and a beverage container simultaneously, as recited n claim 5, wherein said cavity in said second end has a lower portion with a plurality of ribs extending thereacross, said ribs having an upper surface and a lower surface.

9. An assembly for supporting a plate and a beverage container simultaneously, as recited in claim 8, wherein said bracket means is attached to the lower surface of said ribs.

10. An assembly for supporting a plate and a beverage container simultaneously, as recited in claim 9, wherein said lip extending downwardly from the periphery of said base has an edge that extends lower than does said bracket.

11. An assembly for supporting a plate and a beverage container simultaneously, as recited in claim 10, wherein said bracket mates within said cavity in the second end of said base when one plate and a cup holder assembly is vertically stacked onto another plate and a cup holder assembly.

12. An assembly for supporting a plate and a beverage container simultaneously, as recited in claim 11, which is made from an injected molded plastic.

13. A unitary food plate and beverage container holder assembly comprising:

an elongated base having a first end and a second end;

said second end being wider than said first end, permitting coplanar storage of such first end of one assembly adjacent a said second end of a further assembly;

said first end having an annular ridge which defines an opening for the receipt of a beverage container;

said second end having an annular ridge which defines a cavity for receipt of a plate for the emplacement of food therein;

said cavity having a bottom portion having a bottomside, a bracket being secured to said bottomside thereof to permit a user's hand to be emplaced therethrough, to permit secure manipulative control by one hand over said food plate and beverage container assembly;

said base including a webbed portion extending between each of said annular ridges having a utensil securing means thereon to allow the holding of eating utensils in said base.

14. A food plate and beverage container assembly as recited in claim 13, wherein said base has a lip extending downwardly along the peripheral edge thereof, said lip having a curvilinear inner wall surface with a shoulder therein, said base having an upper peripheral edge thereof with a curvilinear outer wall surface with a shoulder thereon, said inner wall surface and said outer wall surface having similar contours to permit mating thereof, when one food plate and beverage container assembly is stacked upon another food plate and beverage container assembly.

15. An assembly for holding food and a beverage container comprising an elongated base having a first end and a second end, said first end having an opening with a swingable bracket disposed across its bottomside for carrying the beverage container, said second end having a cavity for holding food, said second end being wider than said first end;

a lower surface on the bottom of said cavity;

a handle disposed across the bottomside of the lower surface for manipulatively controlling said assembly, said handle of one assembly being arranged so as to mate with a cavity on the second end of another assembly during stacking of one assembly upon another assembly.

16. An assembly as recited in claim 15, wherein said lower surface of said cavity extends entirely across said cavity.

17. An assembly as recited in claim 16, wherein a web of material is disposed between said cavity and said beverage container opening, including a finger for holding utensils thereagainst.

* * * * *